US005322186A

United States Patent [19]

Frazier et al.

[11] Patent Number: 5,322,186

[45] Date of Patent: Jun. 21, 1994

[54] RETROFIT FOLDED TOWEL DISPENSING MODULE

[75] Inventors: Alan D. Frazier; Richard D. Kley, both of West Chester, Pa.

[73] Assignee: Scott Paper Company, Delaware County, Pa.

[21] Appl. No.: 75,438

[22] Filed: Jun. 14, 1993

[51] Int. Cl.[5] ..... B65H 1/00

[52] U.S. Cl. ..... 221/44; 221/65; 312/205

[58] Field of Search ..... 221/33, 44, 45, 46, 221/47, 48, 49, 61, 62, 63, 65, 197, 199, 286, 287, 304; 312/34.1, 34.4, 34.8, 205

[56] References Cited

U.S. PATENT DOCUMENTS

| | | | |
|---|---|---|---|
| 1,724,428 | 8/1929 | Sherman | 221/46 |
| 3,713,561 | 1/1973 | Wyant | 221/44 |
| 4,768,679 | 9/1988 | Matsui | 221/48 |
| 4,811,878 | 3/1989 | Horinchi | 221/44 X |

FOREIGN PATENT DOCUMENTS

| | | | |
|---|---|---|---|
| 1289274 | 2/1969 | Fed. Rep. of Germany | 221/61 X |
| 2195987 | 4/1988 | United Kingdom | 221/44 X |

*Primary Examiner*—D. Glenn Dayoan
*Assistant Examiner*—Dean A. Reichard
*Attorney, Agent, or Firm*—M. G. Bocchetti; J. W. Kane, Jr.

[57] ABSTRACT

A retrofit folded towel dispensing module for use with a wall mounted, folded towel dispenser designed to dispense a folded towel having a predetermined footprint, the folded towel dispensing module enabling the dispenser to dispense folded towels having a different footprint. The module has a frame including a top member, a pair of extensible side members attached to the top member, and a dispensing platform having a dispensing orifice therethrough. The dispensing platform is pivotally attached to the extensible side members. The frame supports a stack of folded towels within the wall mounted, folded towel dispenser. The extensible side members allow the frame to be vertically adjustable within the wall mounted, folded towel dispenser to accommodate differing stack heights of a plurality of different wall mounted, folded towel dispensers.

15 Claims, 4 Drawing Sheets

RETROFIT FOLDED TOWEL DISPENSING MODULE

BACKGROUND OF THE INVENTION

1. Field of the Invention

This invention relates generally to folded towel dispensers, and more particularly to retrofit module inserts for existing folded towel dispensers to allow such dispensers to dispense folded towels of different footprints.

2. Brief Description of the Prior Art

There are a variety of folded towel dispensers known in the prior art. It is typical of such dispensers that they are designed to dispense stacks of folded towels having a particular footprint, the footprint being the planar width and the depth of an individual folded towel in its folded configuration. Many of the existing folded towel dispensers are designed to dispense a particular fold configuration, such as C-fold or interleaved Z-fold. Further, existing towel dispensers are designed to accommodate different maximum stack heights.

There are also varieties of paper towel dispensers which have been designed to dispense more than one type of towel. This is desirable for a number of reasons, one being that it enables towel users to have greater flexibility in purchasing from different companies having different towel products to obtain a more competitive price. One such dispenser is taught in U.S. Pat. No. 3,341,067 to Bastian. That particular dispenser is capable of dispensing both C-fold and multi-fold towels without the necessity of any dispenser-converting members or interchangeable parts. In particular, such dispenser includes a dispensing platform having a stepped shelf adapted to receive folded towels having two different footprints. The width of each towel would be the same and only the depth would vary.

Also known in the prior art are adapter plates and devices designed to be used in conjunction with existing folded towel cabinets to assist in the dispensing of towels therefrom. In some instances, these adapter plates and devices are intended to allow the dispenser to dispense various types of towels and fold configurations. One such adapter plate is taught in U.S. Pat. No. 3,115,998 to Joyce, et al. In that particular adapter plate system, the adapter plate is pivotally supported. There is a towel pack holder which first must be mounted within the dispenser. The adapter plate is then supported from the towel pack holder by means of a hook configuration. This allows the adapter plate to be placed in two different positions, one of the positions accommodating the dispensing of single-fold towel packs and roll towel packs, and a second position accommodating the dispensing of multi-fold towel packs.

U.S. Pat. No. 3,028,047 to Tuft teaches another dispenser which is adapted to dispense a plurality of folded sheets of various fold configurations. This is accomplished through the provision of a plurality of bottom adapter members for a dispenser receptacle which are interchangeable with one another and which are removably engagable with a swing mounted receptacle bin in the dispenser.

Typically, the adapters in the retrofit devices of the prior art are designed such that they are intended for installation into a specific dispenser. The ability to use a particular adapter or retrofit device in a dispenser for which it was not specifically designed is generally left to chance. It is also typical that some towel dispensing cabinets are designed to be recessed into bathroom walls. There are a number of cabinet manufacturers, and it is practice of such cabinet manufacturers to produce a wide variety of cabinets in varying heights, widths and depths. As there is no industry standard for cabinet manufacturers to follow, there are differences between cabinets of different manufacturers. Further, there may even be differences within the same model dispenser from one manufacturer. None of the prior art adapter devices allows for an adjustable stack height such that the adapter device is designed to fit in a plurality of towel cabinets without altering the physical profile of the original cabinet, and further, without any appreciable loss of stack height capacity.

SUMMARY OF THE INVENTION

It is therefore an object of the present invention to provide a retrofit folded towel dispensing module for use with existing towel dispensers which has adjustable side members to accommodate a variety of stack heights.

It is a further object of the present invention to provide a retrofit folded towel dispensing module for use with existing towel dispensers which includes a pivotally mounted dispensing platform which allows the dispensing platform to adjust to various towel cabinet dispensing throat configurations.

Briefly stated, the foregoing and numerous other features, objects and advantages of the present invention will become readily apparent upon reading the detailed description, claims and drawings set forth hereinafter. These features, objects and advantages are accomplished with a retrofit module which is designed with two stationary, opposing side panels, each side panel including an extender member which is adjustable to various heights for proper positioning in towel cabinets having differing stack capacities. The side extenders are interconnected to a top member intended to abut the inside top surface of the existing dispenser cabinet. Pivotally mounted near or at the bottom of each side panel is a dispensing platform. Because the dispensing platform is pivotally mounted, it can assume a more appropriate position depending on the particular throat configuration of the dispenser in which the module is inserted. The front and rear sections of the dispensing platform where the lead and trailing towel edges usually rest may be provided with a radial or arcuate surface configuration which provides a uniform edge for a dispensed towel to clear when being dispensed. The radial surface areas present basically the same towel contact footprint area regardless of the pivot orientation of the dispensing platform within the folded towel cabinet.

Each side extender member is provided with a depth locating tab that provides a means for locating the retrofit module inside towel cabinets that are greater in depth than normal from the front door to the back wall, or at least greater in depth than the depth of the dispensing module. The locating tabs provide a common depth for locating the front of the module top relative to the front top surface of the existing cabinet. Once the module is properly positioned and affixed in the dispenser, the locating tabs may be broken off.

DETAILED DESCRIPTION OF THE PREFERRED EMBODIMENT

Figure 1:
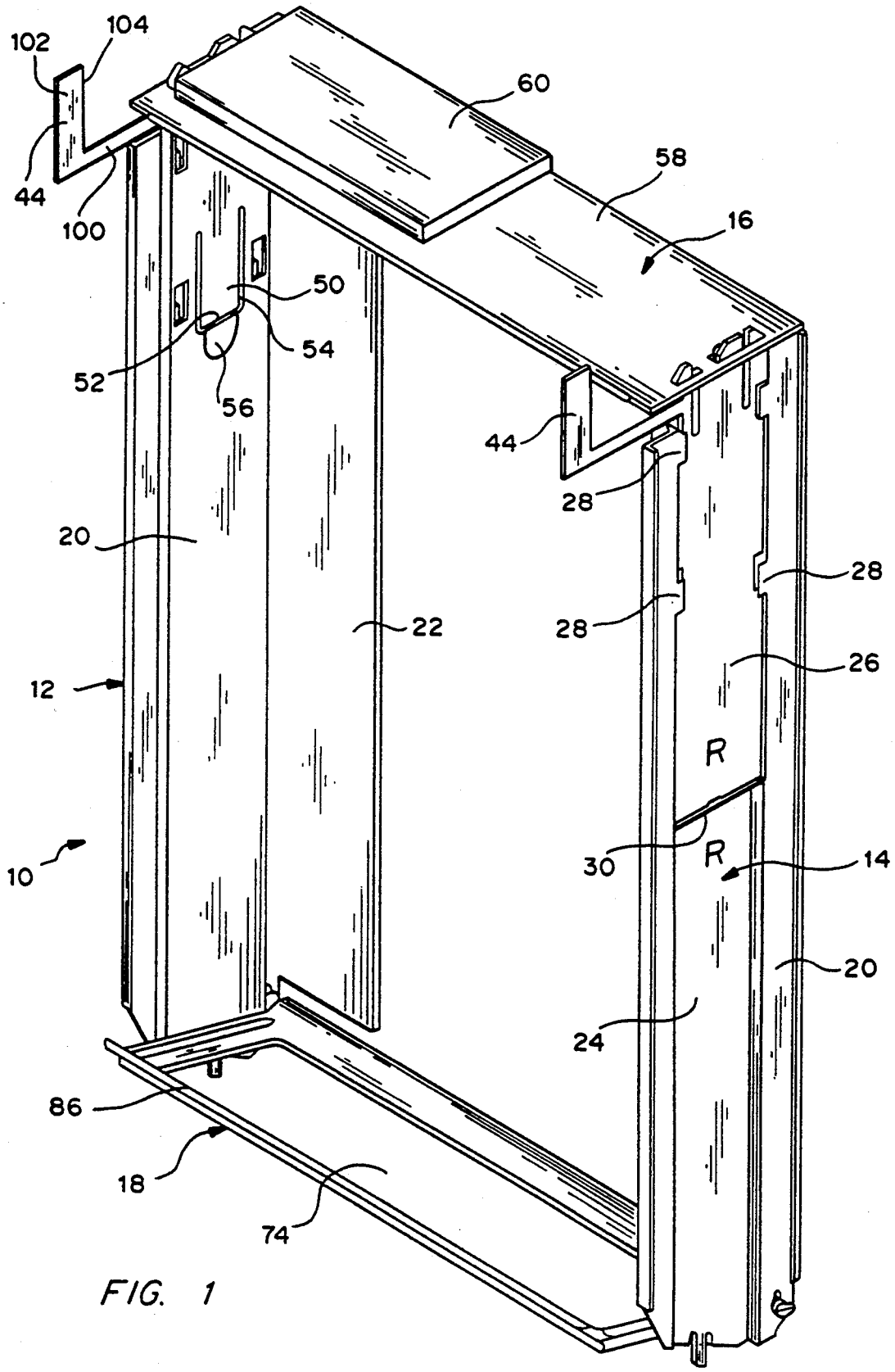
FIG. 1 is a perspective view of retrofit folded towel dispensing module of the present invention.
Figure 2:
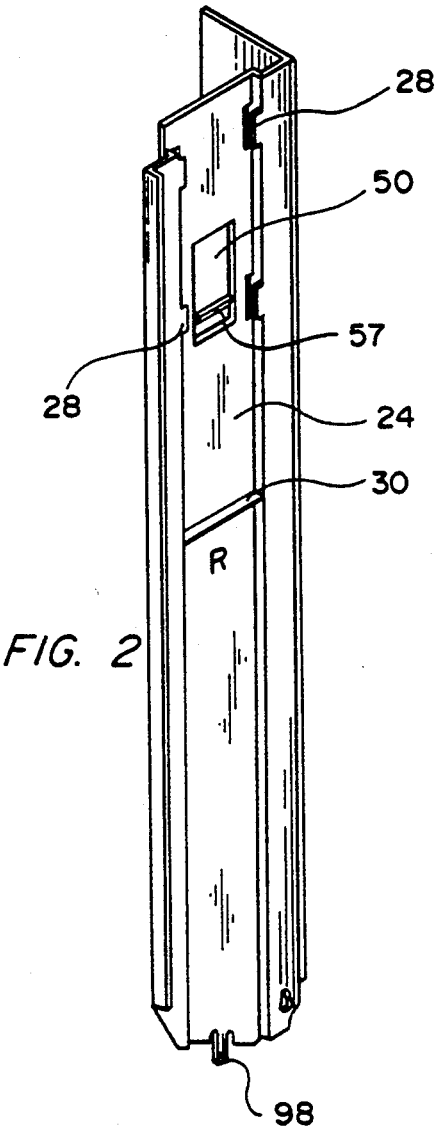
FIG. 2 is a perspective view of the right side panel of the retrofit module of the present invention.
Figure 3:
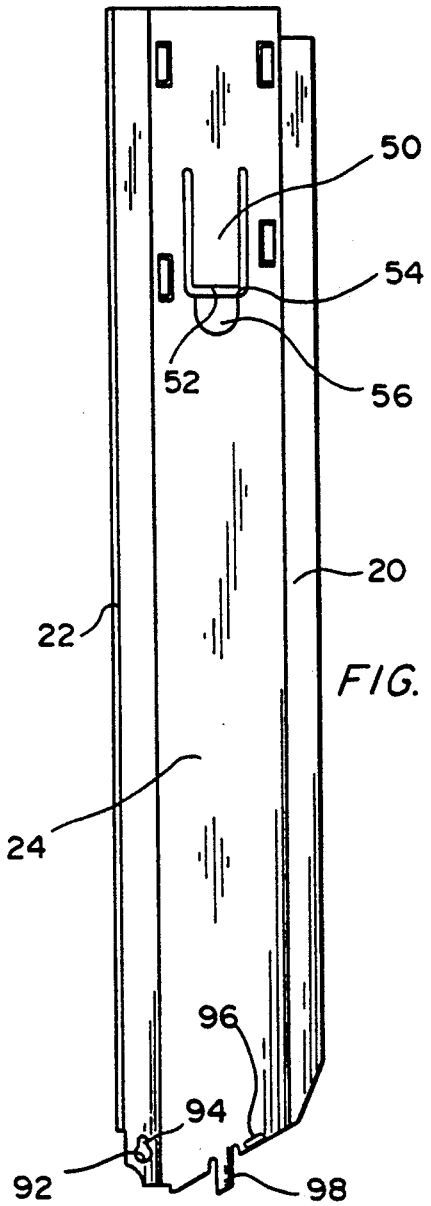
FIG. 3 is a side elevation of the inside face of the right side panel of the retrofit module of the present invention.

Turning first to FIG. 1, there is shown a perspective view of the retrofit folded towel dispensing module 10 of the present invention. Module 10 includes a left extensible side member 12, a right extensible side member 14, a top member 16 and a dispensing platform 18. Left extensible side member 12, right extensible side member 14, top member 16 and dispensing platform 18, when assembled as shown in FIG. 1, form a frame for supporting a stack of towels within the towel dispenser. Left extensible side member 12 and right extensible side member 14 are substantial mirror images of one another, each including a side panel or side wall 20 and a rear panel 22. Each extensible side member 12, 14 includes a channel 24 formed in the outside surface of side panel 20. Right side panel 20 is shown most clearly in FIGS. 2 and 3. Residing slidably in each channel 24 is a side extender 26. Thus, each extensible side member 12, 14 is comprised of a side panel 20 and a side extender 26. Side extenders 26 are retained in channels 24 by means of tabs 28. There is a travel stop 30 extending across each channel 24 which limits the downward travel of side extenders 26 in channels 24.

Figure 4:
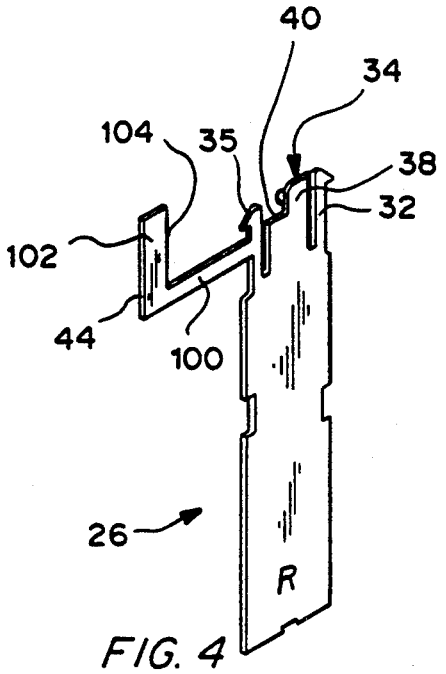
FIG. 4 is a perspective view of the right side extender of the retrofit module of the present invention.
Figure 5:
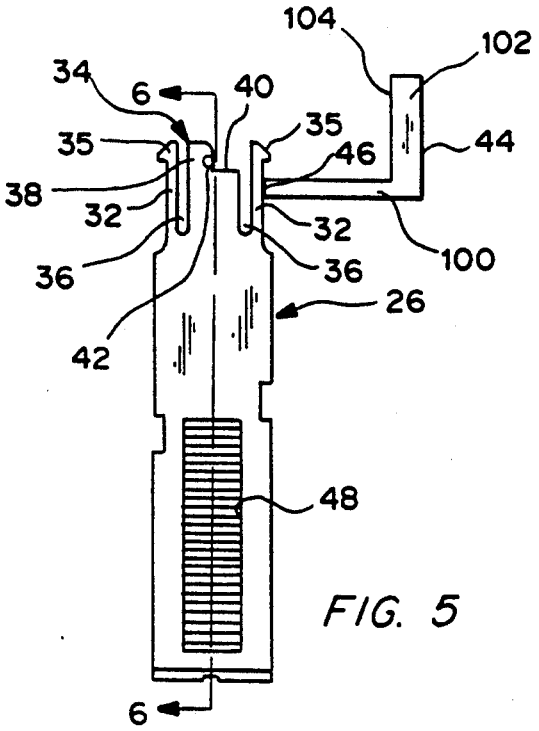
FIG. 5 is a side elevation of the right side extender of the retrofit module of the present invention.
Figure 6:
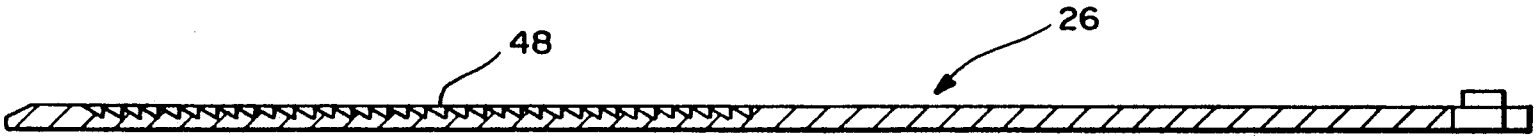
FIG. 6 is an enlarged cross sectional view taken along line 6—6 of FIG. 5.

The top of each side extender 26 (see FIGS. 4 and 5) has a pair of shanks 32 and a key 34 extending therefrom. Each shank 32 has extending from the distal end thereof an interlock gib 35. Each key 34 is separated from shank 32 and interlock gibs 35 by slots 36. Each key 34 includes a guide tab 38, a shelf or bearing surface 40 and positioning or orientation nipple 42. Orientation nipple 42 extends from guide tab 38 substantially perpendicular to the inside planar surface of each key 34. The location of the orientation nipple 42 on each key 34 may be varied slightly to make distinct left and right side extenders 26 thereby ensuring proper orientation upon assembly. Extending from the front of each shank 32 is an L-shaped positioning member 44. There is a fracturing seam 46 where L-shaped positioning member 44 connects to the front of shank 32. Located on the inside surface of each side extender 26 is a plurality of recessed ratchet teeth 48 (see FIGS. 5 and 6).

Formed integrally with each side panel 20 is leaf spring 50. The distal end 52 of each leaf spring 50 is free or unattached. The inside surface of leaf spring 50 is substantially co-planar with the inside surface of side panel 20. Each leaf spring 50 is surrounded on three sides by U-shaped slot 54 which allows each leaf spring 50 to be flexed. Leaf spring 50 is preferably not as thick as side panel 20 to aid its flexibility. Thus, the outside surface or face of each leaf spring 50 is recessed slightly within the respective channel 24. Side panel 20 includes a recess 56 opposite the distal end 52 of leaf spring 50 allowing for the insertion of the human finger therein to engage the distal end 52 to manually flex leaf spring 50. Extending from the outside face of leaf spring 50 adjacent side extender 26 is a projecting tooth 57.

Figure 7:
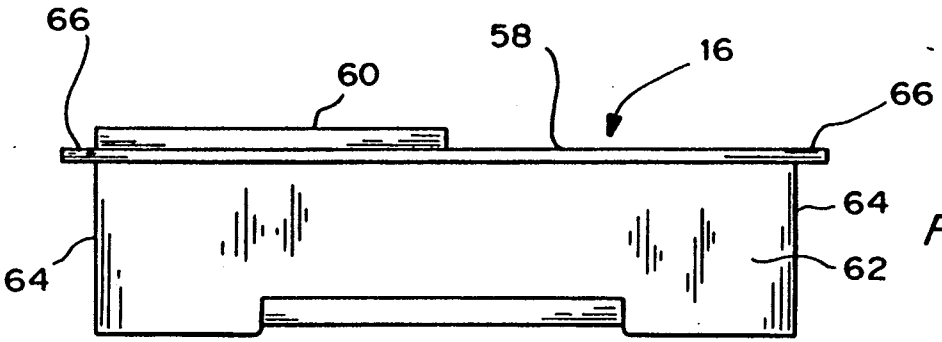
FIG. 7 is a front elevational view of the top member.
Figure 8:
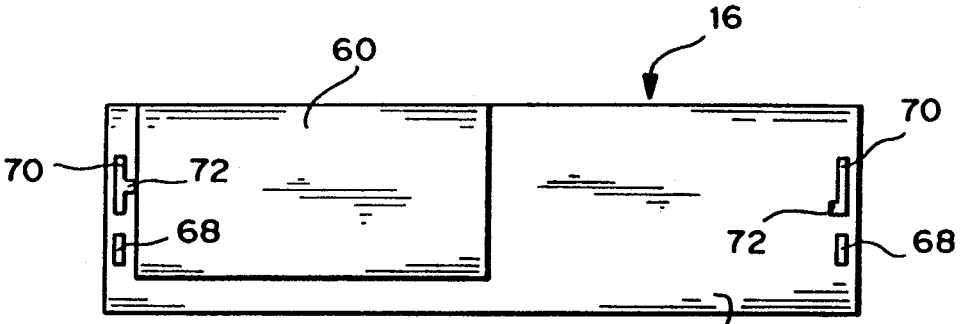
FIG. 8 is a top plan view of the top member.
Figure 9:
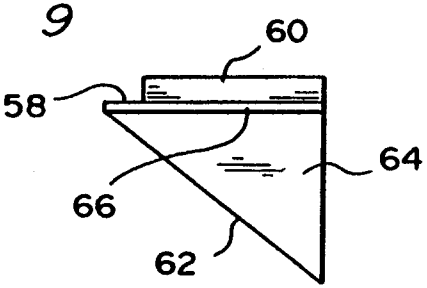
FIG. 9 is a side elevation of the top member.

Looking next at FIGS. 7, 8 and 9, top member 16 preferably includes a plate 58, a locator box 60, an inclined surface 62, gussets 64, and brackets 66. Locator box 60 extends vertically upward from plate 58. In each bracket 66 there is a first interlock slot 68 for receiving one shank 32 and one interlock gib 35. In addition, each bracket 66 has therethrough a second interlock slot 70 for receiving the second shank 32 and interlock gib 35, and a key 34. Second interlock slot 70 has formed contiguously therewith orientation nipple slot 72. As with orientation nipples 42, the location of each orientation nipple slot 72 may be varied slightly to ensure proper orientation of side extenders 26 upon assembly with top member 16.

When assembling extensible side members 12, 14 to top member 16, interlock gibs 35 are inserted into slots 68, 70. Shanks 32 flex toward each other on insertion of interlock gibs 35 which then snap fit into place, locking side extenders 26 to top member 16, with keys 34 and positioning nipples 42 insuring proper orientation of each side extender 26 upon assembly. Bearing surfaces 40 abut each bracket 66 thereby providing support for top member 16.

For ease of assembly, it is preferable to first install side extenders 26 into channels 24. Next, dispensing platform 18 should be mounted on side panels 20. Finally, top member 16 can be attached to side extenders 26.

Figure 10:
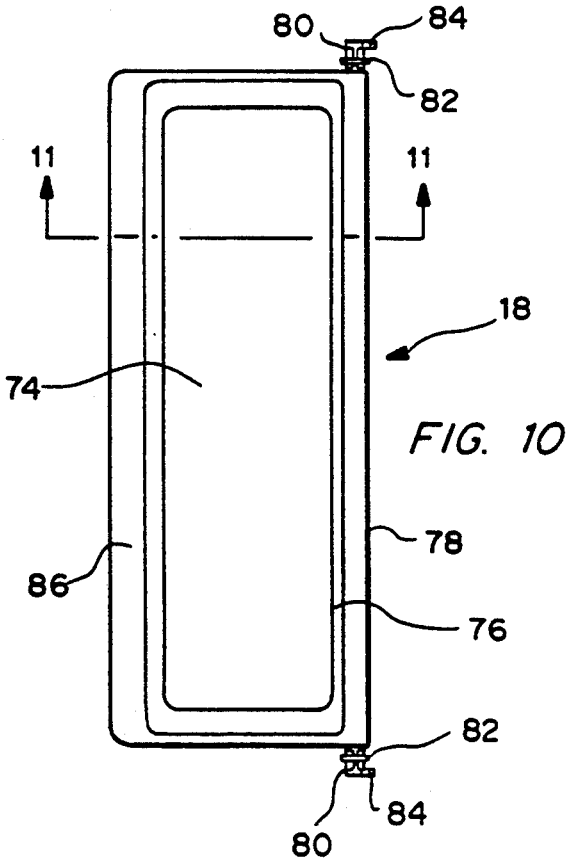
FIG. 10 is a top plan view of the dispensing platform of the retrofit module of the present invention.
Figure 11:
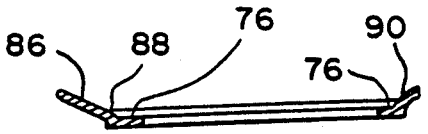
FIG. 11 is a sectional view taken along line 11—11 of FIG. 10.

Turning next to FIGS. 10 and 11, there is shown a dispensing platform 18. Dispensing platform 18 includes dispensing opening 74 with dispensing shelf 76 thereabout. Dispensing platform 18 further includes a support member 78 having pins or journals 80 extending therefrom. Radially extending from journals 80 are disk members 82. Extending from the distal end of each journal 80 is one or more retaining tabs 84. On the opposite side of dispensing opening 74 from support member 78 is sloped lip 86. Sloped lip 86 includes an arcuate surface 88 proximate to dispensing shelf 76. Support member 78 also includes an arcuate surface 90 substantially along the length thereof proximate to dispensing shelf 76.

Dispensing platform 18 is pivotally connected to extensible side members 12, 14 near the base of side panels 20. Side panels 20 have integrally formed therewith, near the bottom thereof, bearings 92. Bearings 92 may include orientation ports 94 contiguous therewith. Extending perpendicularly from side panels 20 are travel stops 96. When assembling dispensing platform 18 to side panels 20, journals 80 are inserted into bearings 92. Retaining tabs 84 insert through orientation ports 94 ensuring proper orientation of dispensing platform 18. Dispensing platform 18 is then pivoted upward such that the bottom thereof rests on travel stops 96. When supported on travel stops 96, dispensing platform 18 will preferably reside at an angle of 90° or less relative to rear panels 22. To initially place dispensing platform 18 in this position of resting on travel stops 96, it will be necessary to slightly flex side panels 20 outward or away from one another so that dispensing platform 18 can be pivoted upward and past travel stops 96.

Side panels 20 have dispensing port locating fingers 98 extending from the bottom thereof. Once extensible side members 12, 14, top member 16, and dispensing platform 18 have been assembled, the module 10 can be placed within an existing dispenser. Dispensing port locating fingers 98 extend down slightly into the dispensing port of the existing dispenser thereby assuring proper alignment of dispensing opening 74 over the port of the existing dispenser.

The module 10 is inserted into the existing wall-mounted dispenser with side extenders 26 in their fully retracted position. For the purposes of this invention, wall-mounted dispensers include any dispensers affixed to or recessed in a vertical surface. Once the module 10 is within the dispenser, the installer presses upward against top member 16 thereby causing side extenders 26 to slide upward in channels 24 until locator box 60 of top member 16 contacts the upper inside surface of the existing dispenser. Because of the interlocking fit of projecting tooth 57 on each leaf spring 50 with recessed ratchet teeth 48, the sliding movement of side extenders 26 within channels 24 is one directional allowing for an incremental or ratchet-like movement until the proper or desired height is reached. If it is desired to retract, either partially or fully, the side extenders 26, recess 56 allows for the insertion of a human finger to engage the bottom of leaf spring 50 to thereby flex leaf spring 50 toward the inside of module 10 thereby causing projecting tooth 57 to disengage from recessed ratchet teeth 48. Once the projecting teeth 57 are disengaged from recessed ratchet teeth 48, side extenders 26 can slide in a downward direction within channels 24. Positioning members or depth locating tabs 44 extending from side extenders 26 ensure that module 10 can be properly oriented within towel dispensing cabinets which are relatively deep from the front door of the cabinet to the back wall. The locating tabs 44 provide a common depth for locating the front of the module 10 relative to the top front surface of the existing cabinet. In other words, as side extenders 26 are raised, the horizontal section 100 of depth locating tabs 44 projects outside the dispenser cabinet. As top section 16 is raised along with side extenders 26, vertical section 102 of depth locating tab 44 is positioned such that its inner edge 104 abuts the upper front surface of the existing cabinet. Once the module 10 is properly positioned within the dispenser, it is affixed in place, typically by means of double sided tape located on the top of locator box 60 or on the back of rear panels 22. Once module 10 is fixed in the proper position, depth locating tabs 44 may be broken off along fracturing seams 46.

As mentioned above, the dispensing platform 18 pivots around journals 80 residing within bearings 92. This allows the dispensing platform 18 to adjust to the various folded towel cabinet dispensing throat configuration. The dispensing platform angle of the existing dispensing cabinet can vary from dispenser to dispenser. Preferably, the sloped lip 86 of the dispensing platform 18 includes the previously mentioned arcuate surface 88, or the support member 78 includes the arcuate surface 90. Most preferably, both arcuate surfaces 88, 90 are present. Arcuate surfaces 88, 90 present basically the same towel contact footprint area regardless of the position of the dispensing platform 18 within the folded towel cabinet. As dispensing platform 18 comes to a resting position within the existing dispenser, because that final resting surface may be at a different position or angle depending on the design of the dispenser, the resting surfaces for the towels placed within the module 10 will always be on the arcuate surface 88, 90, thus providing the towel edges, both leading and trailing, with a similar support surface regardless of the actual operating position of the dispensing platform 18 in the existing cabinet.

The top member 16 of module 10 includes the previously mentioned inclined surface 62. The position of the inclined surface will discourage the over stuffing of towels within module 10. Over stuffing can cause various types of dispensing failures, most commonly jamming. When the stack is under pressure due to over stuffing, dispensing of a single towel becomes difficult, if not impossible. The presence of inclined surface limits those maintaining the dispenser from overfilling by not providing a bearing surface perpendicular to the stack. Since the inclined surface 62 is integrally formed as part of the top member, inclined surface 62 adjusts to near the full height of the existing cabinet as part of top member 16.

Although locator tabs 44 are discussed herein as extending from side extenders 26, it should be appreciated that similar depth tabs could extend from top member 16 to achieve the same purpose.

Preferably, all of the parts of the module 10 of the present invention are plastic. Thus, top member 16 with its above described features, is integrally formed. Also integrally formed would be the dispensing platform 18, as would each side panel 20, and each side extender 26.

From the foregoing, it will be seen that this invention is one well adapted to attain all of the ends and objects herein above set forth together with other advantages which should be apparent to those skilled in the art and which are inherent to the apparatus.

As many possible embodiments may be made of the invention without departing from the scope thereof, it is to be understood that all matter herein set forth and shown in the accompanying drawings is to be interpreted as illustrative and not in a limiting sense.

What is claimed:

1. A retrofit folded towel dispensing module for use with a wall mounted, folded towel dispenser having a towel dispensing port and designed to dispense a folded towel having a predetermined footprint, said folded towel dispensing module enabling the dispenser to dispense folded towels having a different footprint, said folded towel dispensing module comprising:

(a) a top member;

(b) a pair of extensible side members attached to said top member;

(c) a dispensing platform having a dispensing orifice therethrough, said dispensing platform being pivotally attached to said extensible side members, said extensible side members, top member and said dispensing platform forming a frame for supporting a stack of folded towels within the wall mounted, folded towel dispenser, said extensible side members allowing said frame to be vertically adjustable within the wall mounted, folded towel dispenser to accommodate differing stack heights of a plurality of different wall mounted, folded towel dispensers.

2. A retrofit folded towel dispensing module for use with a wall mounted, folded towel dispenser having a towel dispensing port and designed to dispense a folded towel having a predetermined footprint, said folded towel dispensing module enabling the dispenser to dispense folded towels having a different footprint, said folded towel dispensing module comprising:

(a) a top member;

(b) a pair of extensible side members, said extensible side members attached to opposite ends of said top member;

(c) a dispensing platform having a dispensing orifice therethrough, said dispensing orifice aligning with the dispensing port when said module is installed in the folded towel dispenser, said dispensing platform attached to said extensible side members, said extensible side members, top member and said dispensing platform forming a frame for supporting a stack of folded towels within the wall mounted, folded towel dispenser, said extensible side members allowing said frame to be vertically adjustable within the wall mounted, folded towel dispenser to accommodate differing stack heights of a plurality of different wall mounted, folded towel dispensers.

3. A retrofit folded towel dispensing module for use with a wall mounted, folded towel dispenser, said folded towel dispensing module enabling the dispenser to dispense folded towels having a different footprint, said folded towel dispensing module as recited in claim 2 wherein each of said extensible side members is comprised of:

(a) a side panel having a fixed length;

(b) a side extender slidably engaged with said side panel, said side extender movable to a plurality of extending positions relative to said side panel thereby allowing said extensible side members to be extended to a plurality of different lengths;

(c) means for locking said side extender at a selected extending position.

4. A retrofit folded towel dispensing module for use with a wall mounted, folded towel dispenser, said folded towel dispensing module enabling the dispenser to dispense folded towels having a different footprint, said folded towel dispensing module as recited in claim 3 wherein:

said dispensing platform is pivotally mounted to said side panels thereby allowing said dispensing platform to automatically adjust to wall mounted, folded towel dispensers having differing throat configurations.

5. A retrofit folded towel dispensing module for use with a wall mounted, folded towel dispenser, said folded towel dispensing module enabling the dispenser to dispense folded towels having a different footprint, said folded towel dispensing module as recited in claim 3 wherein:

said dispensing platform includes at least one arcuate surface for supporting a stack of towels along a folded edge of the lowermost towel in the stack.

6. A retrofit folded towel dispensing module for use with a wall mounted, folded towel dispenser, said folded towel dispensing module enabling the dispenser to dispense folded towels having a different footprint, said folded towel dispensing module as recited in claim 3 further comprising:

travel stops extending from said side panels to limit the pivotal movement of said dispensing platform to no more than 90° from the vertical.

7. A retrofit folded towel dispensing module for use with a wall mounted, folded towel dispenser, said folded towel dispensing module enabling the dispenser to dispense folded towels having a different footprint, said folded towel dispensing module as recited in claim 3 further comprising:

positioning fingers extending down from said side panels to aid in the alignment of said dispensing orifice with the towel dispensing port.

8. A retrofit folded towel dispensing module for use with a wall mounted, folded towel dispenser, said folded towel dispensing module enabling the dispenser to dispense folded towels having a different footprint, said folded towel dispensing module as recited in claim 2 further comprising:

at least one depth locating tab extending from said module to aid in the positioning of said top member within the dispenser relative to the front face of the dispenser.

9. A retrofit folded towel dispensing module for use with a wall mounted, folded towel dispenser, said folded towel dispensing module enabling the dispenser to dispense folded towels having a different footprint, said folded towel dispensing module as recited in claim 3 further comprising:

(a) a plurality of recessed ratchet teeth in said side extenders;

(b) a leaf spring integrally formed with each of said side panels;

(c) a pawl extending from each of said leaf springs to interact with said recessed ratchet teeth.

10. A retrofit folded towel dispensing module for use with a wall mounted, folded towel dispenser, said folded towel dispensing module enabling the dispenser to dispense folded towels having a different footprint, said folded towel dispensing module as recited in claim 3 wherein:

each of said side panels includes a channel formed therein, said side extenders residing in said channels, each of said leaf springs being located along one of said channels.

11. A retrofit folded towel dispensing module for use with a wall mounted, folded towel dispenser, said folded towel dispensing module enabling the dispenser to dispense folded towels having a different footprint, said folded towel dispensing module as recited in claim 8 further comprising:

a fracturing seam located where said depth locating tab extends from said module to allow said depth locating tab to be easily removed after said top member has been positioned within the dispenser relative to the front face of the dispenser.

12. A retrofit folded towel dispensing module for use with a wall mounted, folded towel dispenser, said folded towel dispensing module enabling the dispenser to dispense folded towels having a different footprint, said folded towel dispensing module as recited in claim 10 further comprising:

a travel stop in each of said channels preventing the downward sliding movement of said side extenders in said channels below a predetermined position.

13. A retrofit folded towel dispensing module for use with a wall mounted, folded towel dispenser, said folded towel dispensing module enabling the dispenser to dispense folded towels having a different footprint, said folded towel dispensing module as recited in claim 3 further comprising:

a rear panel extending from each side panel providing alignment for the rear of the stack of towels.

14. A retrofit folded towel dispensing module for use with a wall mounted, folded towel dispenser, said folded towel dispensing module enabling the dispenser to dispense folded towels having a different footprint, said folded towel dispensing module as recited in claim 3 further comprising:

(a) a bracket located at each end of said top member;

(b) at least one interlock slot in each of said brackets;

(c) a plurality of shanks extending from each of said side extenders;

(d) an interlock gib projecting from each of said shanks for engaging with said interlock slots.

15. A retrofit folded towel dispensing module for use with a wall mounted, folded towel dispenser, said folded towel dispensing module enabling the dispenser to dispense folded towels having a different footprint, said folded towel dispensing module as recited in claim 1 further comprising:

a positioning finger extending down from each of said extensible side members to aid in the alignment of said dispensing orifice with the towel dispensing port.

* * * * *